United States Patent [19]

Fugazza et al.

[11] Patent Number: 4,543,922

[45] Date of Patent: Oct. 1, 1985

[54] STARTER FOR INTERNAL COMBUSTION ENGINES

[75] Inventors: Ermanno Fugazza, Rivoli; Giuseppe Dal Poz, Pianezza, both of Italy

[73] Assignee: A.M.S.E.A.-Azienda Meccanica, Caselette, Italy

[21] Appl. No.: 499,523

[22] Filed: May 31, 1983

[30] Foreign Application Priority Data

Jun. 7, 1982 [IT] Italy ..... 21728 A/82

[51] Int. Cl.[4] ..... F02N 5/00

[52] U.S. Cl. ..... 123/179 S; 74/6; 185/39

[58] Field of Search ..... 123/179 S, 179 SE, 185 R; 185/37, 39, 41 A; 74/6

[56] References Cited

U.S. PATENT DOCUMENTS 1,056,972 3/1913 Coleman ..... 185/41 A
1,820,967 9/1931 Enyeart ..... 185/37
4,240,525 12/1980 Kubiatowicz ..... 185/37
4,441,466 4/1984 Tangorra ..... 123/179 S

FOREIGN PATENT DOCUMENTS 845237 8/1939 France ..... 185/37
457267 11/1936 United Kingdom ..... 185/37

*Primary Examiner*—Andrew M. Dolinar
*Attorney, Agent, or Firm*—Stevens, Davis, Miller & Mosher

[57] ABSTRACT

A starter for internal combustion engines having a stationary box-shaped envelope enclosing a rotatable disc-shaped body. A strip of elastomeric material having its ends secured to the stationary envelope crosses the rotatable disc-shaped body and engages pins projecting therefrom. A manually rotatable handle is provided to rotate the rotatable body, thus winding and stretching the elastomer strip. Means are provided to release the loaded elastomeric strip and thus rotate the engine to start it.

7 Claims, 4 Drawing Figures

STARTER FOR INTERNAL COMBUSTION ENGINES

BACKGROUND OF THE INVENTION

The present invention relates to a starter for internal combustion engines and, more particularly, to those starters for internal combustion engines of the type comprising a pair of disc-shaped bodies rotatable with respect to each other so as to deform a strip of elastomeric material which stores energy and supplies it to the shaft of an internal combustion engine to start the engine. Starters for internal combustion engines of this type are known.

Known starters of the type in question, although having good reliability and capability of storing a high quantity of energy so as to make the starting of a high power internal combustion engine possible, are heavy and bulky.

The heavy weight and the large overall dimensions of the known starters for internal combustion engines of this type has made it difficult for commercial use of said starters for small volume and low power engines, which are usually used on hand-operated and transport machines, as, for example, lawn mowers and power saws.

BRIEF DESCRIPTION OF THE INVENTION

One object of the present invention is to make a starter for internal combustion engines which is of relatively light weight while still permitting storing of a good quantity of energy, as required for the starting of an internal combustion so as to obtain a very good reliability and lifetime of the starter in spite of its light weight. It will increase also the safety of the operators of the machines which make use of said starter, in comparison with the present devices used on such machines.

Another object of the present invention is to provide a starter for internal combustion engines comprising a box-shaped envelope, securable to the body of the internal combustion engine, a disc-shaped body encased within the box-shaped envelope coaxial and rotatable with respect to the latter, elastically deformable means connecting the box-shaped envelope with the disc-shaped body, means for imparting relative rotation to the disc-shaped body with respect to the box-shaped body, thus causing the deformation of the elastically deformable means and means for engaging and releasing the disc-shaped body from the rotation shaft of an internal combustion engine, characterized by the fact that the elastically deformable means is a single strip of elastomeric material wound between two pins integral with the box-shaped body and arranged in a position diametrically opposed to the disc-shaped body, said strip crossing the disc-shaped body and passing through pairs of pins projecting from the disc.

BRIEF DESCRIPTION OF THE DRAWINGS

The present invention will be better understood by the following detailed description made by way of non-limiting example with reference to the figures of the accompanying sheets of drawings, in which.

DESCRIPTION OF A PREFERRED EMBODIMENT

In its more general aspects, a starter for internal combustion engines according to the present invention comprises a stationary box-shaped body for connection to the body of an internal combustion engine and a rotatable disc-shaped body, encased within the box-shaped body, rotatable about its own axis and provided with means for being connected with and released from the shaft of an internal combustion engine.

A strip of elastically deformable material and, more particularly, a strip of elastomeric material has its ends connected to a box-shaped body (stator) in positions on diametrically opposite sides of the axis of rotation of the disc-shaped body. The strip of elastically deformable material crosses, therefore, the disc-shaped body, passing through pairs of rollers on pins connected to the disc-shaped body so as to give the strip of elastically deformable material an undulated configuration in the zone where it crosses the disc-shaped body.

In particular, in its more general aspects, the strip of elastically deformable material has the configuration of a flattened annular body.

Figure 1:
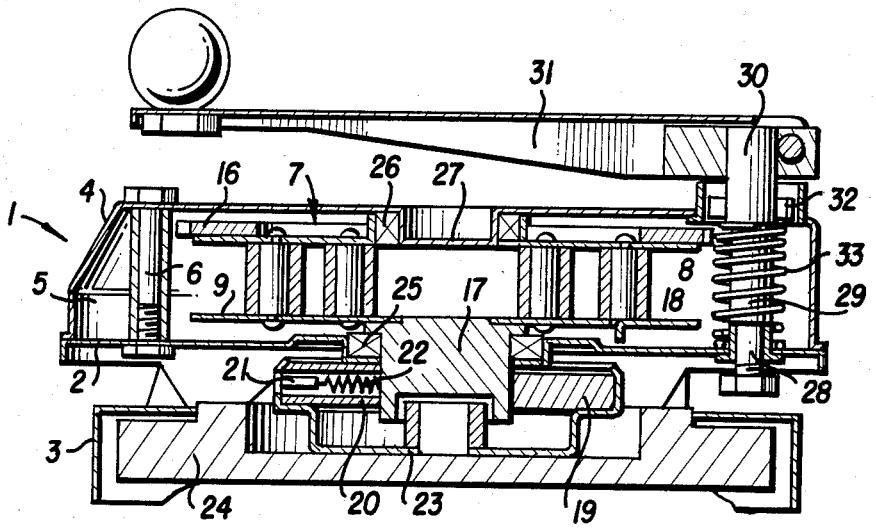
FIG. 1 is a side view partially in section of a starter according to the invention, with parts broken away, in order to better show the structure.
Figure 2:
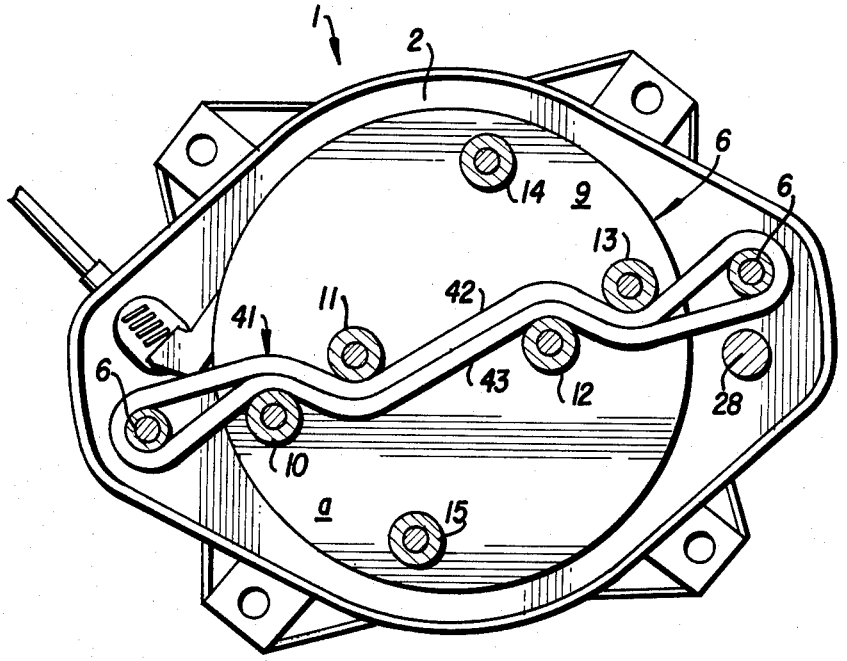
FIG. 2 is a plan view, with parts broken away, of a starter according to the invention in unloaded condition.

FIGS. 1 and 2 depict a starter for internal combustion engines according to the present invention in a preferred embodiment.

As shown in FIGS. 1 and 2, a starter for engines according to the present invention comprises a box-shaped body 1 having a base 2 secured to the body of an internal combustion engine 3 by known means, such as screws, bolts and the like not shown.

An envelope 4 is secured on base 2 so as to define, together with the base 2, a cavity 5 inside of the box-shaped body 1.

The connection between envelope 4 and base 2 is made through bolts 6, and preferably by a pair of bolts 6 on which there is mounted a cylindrical sleeve so that the bolts 6 may serve as pins.

Within the box-shaped body 1 there is a disc-shaped body 7. The disc-shaped body 7 is formed of two circular plates 8 and 9, spaced apart and connected to each other by pins 10, 11, 12, 13, 14 and 15.

The pins 10 and 11 and the pins 12 and 13 form together pairs of pivots whose axes lie on planes parallel to one another, but those planes do not pass through the center of rotation of the disc-shaped body 7.

Moreover, the pins 10, 11 and 15 lie in quadrant sector a, which is the sector opposite to quadrant sector b in which lie the pins 12, 13 and 14.

The disc-shaped body 7 is further provided on plate 8, with a gear wheel 16 projecting from the periphery of plate 8.

The plate 9 carries a cylindrical body 17 projecting downwardly from its face, that is, projecting from the side opposite plate 8. On the face from which the body 17 projects, plate 9 has a crown 18 provided with notches, as better described later on.

On the outer surface of the cylindrical body 17 there is an integral disc 19, having on its periphery a series of cavities 20 in which there is encased latches 21, radially movable outwardly and biased by springs 22.

The disc 19 is surrounded by a sleeve 23 firmly secured to the flywheel 24, integral with the shaft of an internal combustion engine.

The disc-shaped body 7 rotates within the cavity 5 of the box-shaped body 1, and is supported for rotation by bushings, said bushings being indicated with the reference numerals 25 and 26.

More particularly, the bushing 25 is interposed between the base 2 of the box-shaped body 1 and the body 17 of the disc-shaped body 7, while the bushing 26 is interposed between a depression 27 in the center of the envelope 4 and a relief in the plate 8 of the disc-shaped body 7.

The box-shaped body 1 is, moreover, provided with a further pin 28 arranged between the base 2 and the envelope 4, on which a sleeve 29 is keyed, said sleeve bearing at its end 30 a crank 31 through which the loading of the starter is effected.

To this end, on the sleeve 29 there is fixed a crown gear 32 adapted to engage with and released from the gear wheel 16 borne by the disc-shaped body 7. Moreover, between the crown gear 32 and the base 2 of the box-shaped body 1 there is a helicoidal spring 33 which keeps the crown gear 32 spaced from the gear wheel 16, as shown in FIG. 1.

Figure 4:
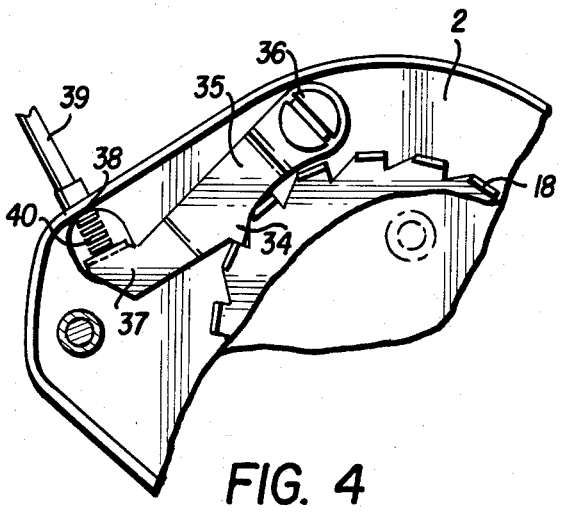
FIG. 4 shows a detail of a starter according to the invention.

As previously indicated, in connection with disc 9 of the disc-shaped body 7 there is a crown 18 provided with notches; the details of this and elements associated therewith are shown in FIG. 4.

As shown in FIG. 4, the crown 18 provided with notches engages with a "V" shaped protuberance 34 projecting from a lever 35 hinged at 36 to base 2 of the box-shaped body 1.

A flexible cable 38 extends from the other end 37 of the lever 35, said flexible cable, after passing through the wall of the envelope 4 of the box-shaped body 1, is encased within a flexible tube 39. Interposed between the end 37 of the lever 35 and the inner surface to the cavity 5 is a spring 40, which keeps the end 37 of the lever 35 spaced from the inner surface of the cover 4 of the box-shaped body 1.

The starter for engines according to the present invention is provided with elastically deformable means able to store therein energy for deformation of the elastically deformable element.

FIG. 2 shows the elastically deformable means. As shown in FIG. 2, the elastically deformable means preferably consists of a closed loop 41 of elastomeric material which is fitted around pins 6, through which the connection of the base 2 to the envelope 4 of the box-shaped body 1 is effected.

By fitting the loop 41 of elastomeric material around the pins 6, there are defined two branches 42 and 43 of the loop 41.

Both the branches 42 and 43 are passed, doubled together, between the pairs of pins 10, 11 and 12, 13.

In this way, as shown in FIG. 2, the ring of elastomeric material has an undulated shape and, more particularly, the zig-zag shape shown in FIG. 2 which maintains stresses in the elastomeric material even in the rest position.

The operation of this starter for internal combustion engines according to the present invention will now be described in detail.

Starting from the condition represented in FIGS. 1 and 2, in which the starter is represented in unloading condition, to load the starter one has to act as follows:

At first, the operator presses the end of the lever 31 above its connection to pin 30.

In consequence of said pressure, the resistance of the spring 33 is overcome and the crown gear 32 is engaged with the gear wheel 16, which is mounted on the disc-shaped body 7.

After this operation, the operator manually rotates the lever 31, thus causing rotation of the disc-shaped body 7 with respect to the box-shaped body 1.

Figure 3:
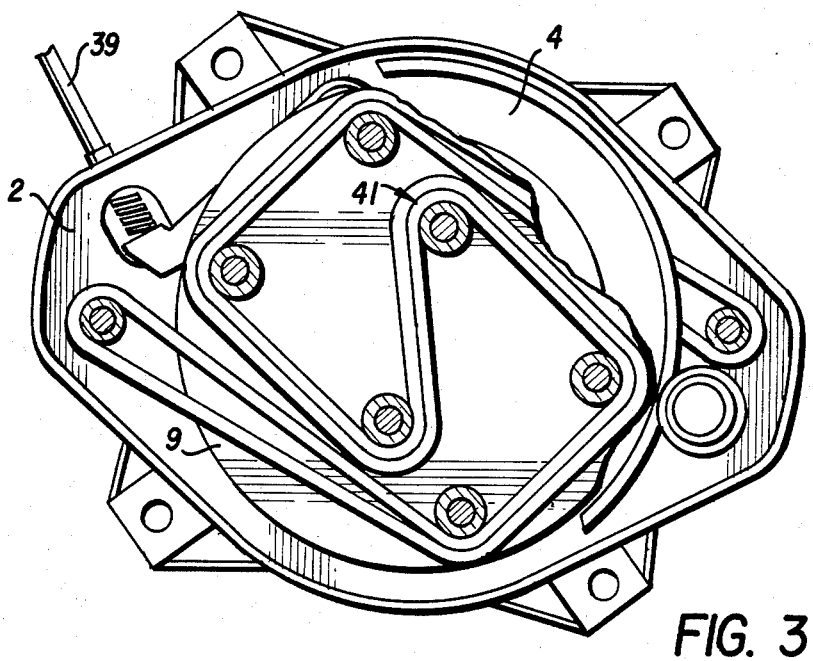
FIG. 3 is a plan view, with parts broken away, of a starter according to the invention in loaded condition.

The rotation of the disc-shaped body 7 with respect to the box-shaped body 1 causes the loop 41 of elastomeric material to be deformed, so as to assume the shape shown in FIG. 3.

The deformation of the loop 41 (loading) is maintained because the "V" shaped protuberance 34 and the teeth of the crown 18 act as a rachet and pawl.

Following the loading of the starter as indicated above, the delivering of the energy stored in the loop 41 of elastomeric material is obtained as follows.

At first, the operator stops exerting pressure on the end of the lever 41 so that the crown gear 32 is released from the gear wheel 16 by the axial extension of compression spring 33.

Then, by pulling a suitable lever or handle (not shown) at the distal end of cable 38, the end 37 of the lever 35 pivots and, overcoming the resistance of the spring 40, the protuberance 34 is released from the notches of the crown notches 18.

In this way, the disc-shaped body 7 is released to rotate with respect to the box-shaped body 1, and the rotation of said disc-shaped body 7 is caused by the action of the energy stored in the loop 41 of elastomeric material.

With the rotation of the disc-shaped body 7 around its axis, there is applied centrifugal force to the elements integral with the disc-shaped body 7.

Under the action of this centrifugal force, the latches 21, encased in the cavity 20 of the disc-shaped body 19, project outwardly, overcoming the resistance of the springs 22. The latches 21, after moving radially outwardly, engage with the opening carried by the sleeve 23 integral with the flywheel 24 and, therefore, with the shaft of the internal combustion engine.

In this way, the energy stored in the loop 41 of elastomeric material is supplied to the shaft of the internal combustion engine, thus rotating the engine.

From the above description, it is easily understandable that the stated objectives are achieved.

All of the parts of the starter can be made with stamped or shaped plates and are therefore light in weight.

Moreover, the use of a single loop of elastomeric material enable a starter of small physical size to be built.

The zig-zag shape imposed on the loop of elastomeric material and the stresses present therein as a result of its zig-zag shape, when loading the starter, permits said loop to operate also as a shock-absorber at the end of the unloading phase, thus avoiding vibrations. Because of the lightness of the mechanical parts of the starter, such vibration could be very detrimental to the useful lifetime of the starter and for its long term working reliability.

Moreover, the particular arrangement of the pins carried by the rotating disc-shaped body, which maintains to the two branches of the ring in contact in each other at any moment, as a result acts to reduce the vibrations of the branches of the elastomer loop, and therefore in the loop itself during the unloading phase of the starter, since the vibrations of one branch act as dampers for the vibrations of the other branch. Also, this fact leads to an extended useful lifetime of the starter and assures extended working reliability.

Although an embodiment of the invention has been illustrated and described, it is understood that this invention includes in its scope any other alternative embodiment occurring to a technician in this field.

We claim:

1. A starter for an internal combustion engine, comprising:

a stator body for mounting on a stationary portion of an internal combustion engine provided with a shaft, said stator body defining an enclosure for a rotor;

a rotor within said stator body for mounting on the shaft of said engine and means for connecting and disconnecting said rotor to said shaft;

means for manually rotating said rotor in relation to said stator;

at lease two securing means on said stator in the form of a pair of pins positioned on diametrically opposite sides of said rotor;

first and second pairs of pins on the rotor positioned so that one pair is near one securing means and the other pair is near the other securing means, one pair of pins being in one quadrant of the rotor and the other pair of pins being in a diametrically opposite quadrant thereof;

each one of said first and second pairs of pins having one radially outer pin and a radially inner pin; an additional pin in each said opposite quadrant and near the periphery of said rotor;

a flattened strip of elastomeric material in the form of a closed loop;

said closed loop being fitted around said two securing means and defining two branches doubled together, which are passed across the rotor between each pair of pins of said opposite quadrant;

said two branches doubled together forming an undulated shape which maintains stresses in the elastomeric material even in the rest position;

whereby when the rotor is rotated to wind the elastomeric strip about the pins, the two radially outer pins of said pairs of pins and said two additional pins form a rectangular path for the stretched strip and the two radially inner pins of said pairs of pins form a "Z" shaped path for said stretched material.

2. The starter of claim 1, in which the means for connecting and disconnecting the rotor to the shaft includes means for remote operation thereof.

3. The starter of claim 1, in which said pins are positioned to lie so that a line connecting the centers of the pins in a pair does not cross the center of said rotor.

4. The rotor of claim 1, in which a first line connecting the centers of said first pair of pins and a second line connecting the centers of said second pair of pins are parallel to each other but with neither line passing over the center of said rotor.

5. The starter of claim 1 comprising a box-shaped body having a base secured to the body of said internal combustion engine, an envelope secured on said base to define a cavity inside the said box-shaped body, wherein said securing means in the form of pins are formed by bolts on which cylindrical sleeves are mounted.

6. The starter of claim 1 wherein said rotor is formed by two circular plates spaced apart and connected by said pairs of pins and said two additional pins.

7. The starter of claim 6 wherein one of said plates carries a cylindrical body with an integral disc having on its periphery a series of cavities enclosing latches radially movable outwardly and biased by springs, said disc being surrounded by a sleeve firmly secured to a flywheel integral with the shaft of the internal combustion engine.

* * * * *